United States Patent [19]

Hoffman et al.

[11] Patent Number: 5,040,273

[45] Date of Patent: Aug. 20, 1991

[54] SHOULDER STRAP BUTTON ADJUSTMENT MEANS

[76] Inventors: Janice Hoffman; Fredrick M. Weintraub, both of 104 Grotke Rd., Chestnut Ridge, N.Y. 10972

[21] Appl. No.: 498,727

[22] Filed: Mar. 26, 1990

[51] Int. Cl.[5] ..... A44B 11/00

[52] U.S. Cl. ..... 24/322; 24/321; 24/199; 24/90 TA

[58] Field of Search ..... 24/319, 320, 321, 322, 24/323, 199, 90 TA, 464; 2/325, 326, 327

[56] References Cited

U.S. PATENT DOCUMENTS

| | | | |
|---|---|---|---|
| 335,794 | 2/1886 | Bretzfield | 24/323 |
| 709,909 | 9/1902 | Jenkins | 24/321 |
| 768,928 | 8/1904 | Breese | 24/321 |
| 1,504,234 | 8/1924 | Green | 24/321 |
| 1,950,064 | 3/1934 | Pugniet | 24/464 |
| 2,262,688 | 11/1941 | Lozo | 24/319 |
| 2,473,209 | 6/1949 | Lombardi | 24/321 |
| 3,135,032 | 6/1964 | Althens | 24/90 TA |
| 3,537,155 | 11/1970 | Burchett | 24/464 |
| 3,785,009 | 1/1974 | Nysten | 24/90 TA |
| 3,816,200 | 6/1974 | McKenna | 24/90 TA |

FOREIGN PATENT DOCUMENTS

| | | | |
|---|---|---|---|
| 805318 | 5/1951 | Fed. Rep. of Germany | 24/199 |

*Primary Examiner*—Victor N. Sakran

*Attorney, Agent, or Firm*—Iman Abdallah

[57] ABSTRACT

A button adjustment apparatus for the straps of a child's garment. The apparatus includes a base member having three transverse slots and a button fixedly attached between two of the slots. The garment straps are threaded through the slots so that the button can be selectively adjusted along the length of the strap by sliding the straps in the slots of the base member.

12 Claims, 2 Drawing Sheets

SHOULDER STRAP BUTTON ADJUSTMENT MEANS

BACKGROUND OF THE INVENTION

The present invention generally relates to fasteners for wearing apparel. More specifically this invention relates to adjustable fasteners for children's wearing apparel having shoulder straps.

The invention of this disclosure is most suitable for use on children's clothing because of the growth spurts experienced by toddlers and young children. The quickly changing height of a growing child often results in clothing becoming too small before it is greatly worn. In response to this pattern many clothing manufacturers provide children's clothing with shoulder straps that can be adjusted to accommodate the varying height of a child. A common adjustable fastener known in the prior art is the clasping type fastener as used on overalls. These fasteners are often made of a metal material which may cause injury to a child during one of their many trips and falls. To adjust children's clothing having buttoned fasteners requires that the button be removed and repositioned at each stage of a child's growth.

SUMMARY OF THE INVENTION

The present invention provides a shoulder strap fastener that can be adjusted along the length of a shoulder strap to change the effective length of the shoulder strap. This invention is particularly directed to shoulder straps on articles of clothing having a button fastener that attaches to a buttonhole on the bib or other portion of the article of clothing. The apparatus comprises a base member formed of pliable plastic having a plurality of transverse slots formed therein in parallel alignment. A button is fixedly attached to said base member between a pair of said transverse slots. The shoulder strap is selectively threadable through the transverse slots to secure the button at the desired position.

An object of the present invention is to provide simple means for adjusting the position of a button on a shoulder strap.

It is also an object of this invention to eliminate the need for removing and repositioning a button on a shoulder strap to alter the effective length of the shoulder strap.

These and other objects and advantages of the present invention will be apparent to those skilled in the art from the following description of preferred embodiments, claims and accompanying drawings.

DESCRIPTION OF THE PREFERRED EMBODIMENTS

Figure 1:
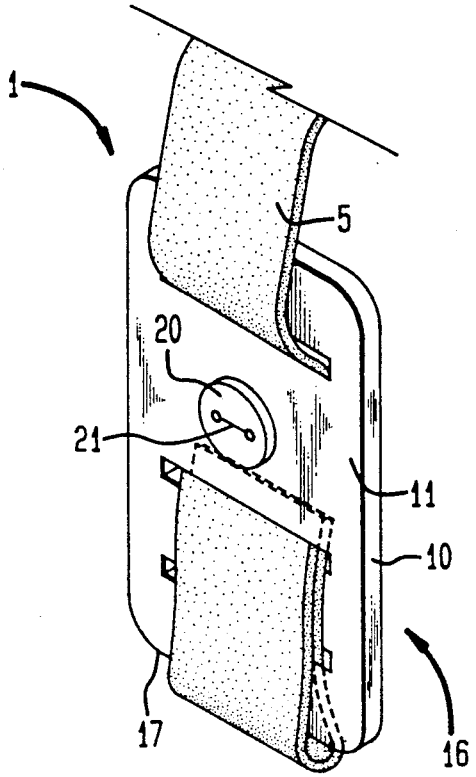
FIG. 1 is a perspective view of a first preferred embodiment of the apparatus of the present invention shown attached to a fragmented portion of a shoulder strap.
Figure 2:
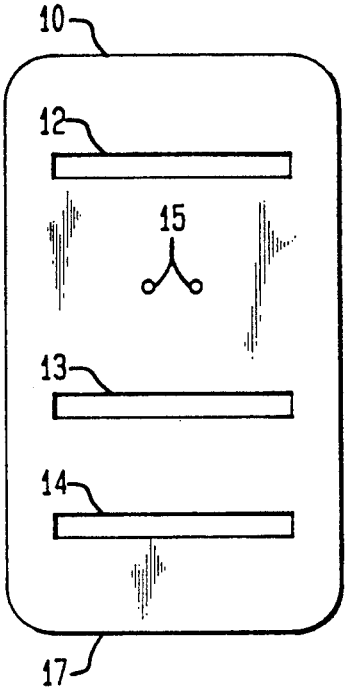
FIG. 2 is a front plan view of the base member of the first preferred embodiment shown in FIG. 1.
Figure 3:
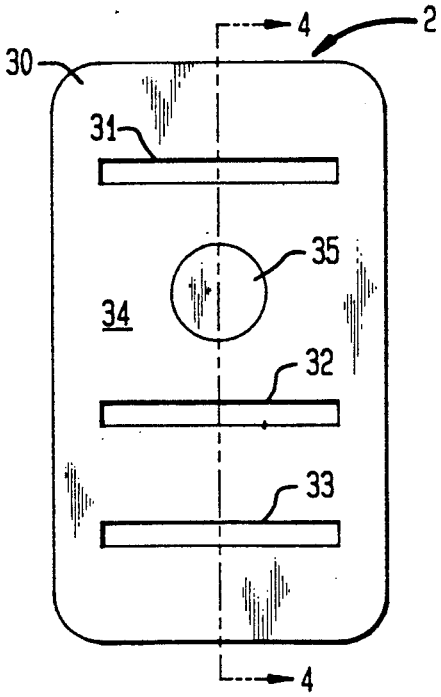
FIG. 3 is a front plan view of a second preferred embodiment of the present invention.
Figure 4:
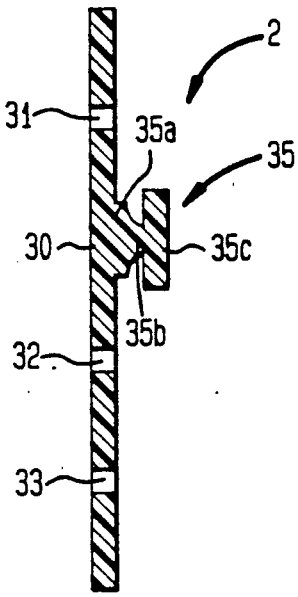
FIG. 4 is a cross-sectional view taken along line 4—4 of FIG. 3.
Figure 5:
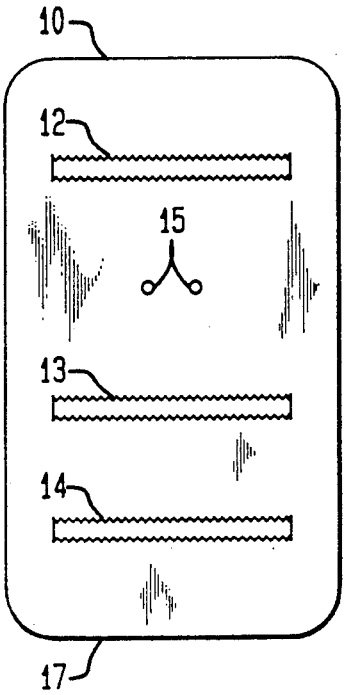
FIG. 5 is a front plan view of the first base member having teethed slots.

FIG. 1 illustrates in a perspective view a first preferred embodiment of the shoulder strap fastener 1 of the present invention. Shoulder strap fastener 1 is shown attached to a shoulder strap 5 of an article of clothing, for example, a child's bibbed jump suit. The shoulder strap fastener 1 includes a base member 10, preferably formed from a pliable plastic material, and a button 20 fixedly attached to the forward face 11 of the base member 10. As can be seen in FIG. 2 the base member 10 is a substantially rectangular member having rounded corners and a plurality of transverse slots 12, 13 and 14 formed therein in parallel alignment, shown in FIG. 1 to be three in number. A first slot 12 is formed in the upper portion of said base member 10 and is disposed in spaced relationship from a second slot 13 and a third slot 14 formed in the lower portion of said base member 10. The distance between said first slot 12 and said second slot 13 is relatively wider than the distance between said second slot 13 and said third slot 14. Said slots 12, 13, 14 may be formed with a smooth slot surface as shown, or alternatively the slots 12, 13, 14 may be roughed, ground or teethed (FIG. 5) to increase the stability of a shoulder strap 5 disposed therein. A pair of horizontally aligned small circular openings 15 are formed in said base member 10 at proximately equal distance between said first slot 12 and said second slot 13. The circular openings 15 are provided for receipt of loops of thread 21 to fixedly attach the button 20 to said base member 10 (FIG. 1). Referring again to FIG. 1 it can be seen that the shoulder strap 5 is threaded through the transverse slots 12, 13, 14 in slidable engagement by first passing the end of the strap across the top portion of the forward face 11 of the base member 10 through the first slot 12, and then across the rearward face 16 of the base member 10 through said second slot 13. The strap 5 is then passed across the lower portion of the base member 10 over the third slot 14 and looped around the lower edge 17 of the base member 10 and passed from the rearward face 16 of said base member 10 through the third transverse slot 14, thereby securing the strap 5 in the desired position. Second slot 13 is formed sufficiently wide to receive a double thickness of said shoulder strap 5 as shown in FIG. 1. Thus the shoulder strap fastener 1 may be selectively positioned along the length of said shoulder strap 5 by varying the length of strap 5 that is threaded as heretofore described through said fastener 1 to adjust the position of the button 20 as desired Referring now to FIG. 3 a second shoulder strap fastener 2 constructed in accordance with the teachings of the present disclosure is shown in a front plan view. The second shoulder strap fastener 2 includes a second base member 30 substantially similar to the base member 10 shown and described for the first preferred embodiment including similarly disposed transverse slots 31, 32, 33. In lieu of the circular openings 15 of said first shoulder strap fastener 1 provided for attachment of a button 20, the second shoulder strap fastener 2 includes a button member 35 disposed between the first slot 31 and the second slot 32 that is integrally formed with the forward face 34 of said base member 30. As can be seen in the cross-sectional view of the second preferred embodiment shown in FIG. 4 the button member 35 includes a button member base **35*a* integrally disposed adjacent to the forward face 34 of the base member 30**.

Figure 6:
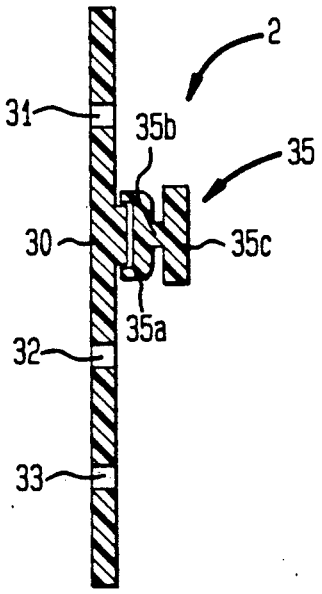
FIG. 6 is a cross-sectional view of a third embodiment of the present invention.

The button member base 35*a* has a forwardly extending neck 35*b* having convexly-curved walls of narrowing diameter which extend to an integrally formed button member head 35*c*, said button member head 35*c* being provided for engagement with the buttonhole (not shown) of the article of clothing to which the second shoulder strap fastener 2 is attached Button member 35 may alternatively be formed as a separate unit having a button member base 35*a* formed with a flat outer face that is attachable to said second base member 30 by adhesive means or as shown in FIG. 6 button member 35 may be attachable to second base member 30 by detachable means disposed on the button member base 35*a*. The strap 5 of a garment is threadedly attached within the transverse slots 31, 32, 33 of said second shoulder strap fastener 2 as heretofore described for the first shoulder strap fastener 1.

While the present invention has been described in conjunction with a shoulder strap of children's clothing it should be understood that this invention may be utilized with other articles of clothing or articles of manufacture and various changes can be made without departing from the spirit and scope of the present disclosure. For examples, a four-holed button or snap fasteners in lieu of a button may be attached to the base member Such changes and alterations to the preferred embodiments disclosed herein are intended to be included within this invention as held in the following claims.

We claim:

1. An adjustable shoulder strap fastener for an article of clothing having a shoulder strap and a bib portion, said shoulder strap fastener comprising, a base member having a plurality of transversely extending slots formed therein in parallel alignment, said base member being formed of pliable material and said shoulder strap being attachable to said base member by threaded engagement of said strap within the transversely extending slots of said base member; and fastener means fixedly attached to said base member between a pair of said plurality of slots which selectively engage the bib portion of said article of clothing thereby providing selective attachment of said shoulder strap and the bib portion of said article of clothing.

2. A shoulder strap fastener as described in claim 1 wherein said base member is formed of a soft plastic material.

3. A shoulder strap fastener as described in claim 1 wherein three transversely extending slots are formed in said base member, a first slot being formed in the upper portion of said base member and respective second and third slots being formed in the lower portion of said base member, said fastener means being disposed between said first slot and said second slot, the distance between said first slot and said second slot being relatively wider than the distance between said second slot and said third slot for receipt of fastener means.

4. A shoulder strap fastener as described in claim 3 wherein said first, second and third slots are teethed.

5. A shoulder strap fastener as described in claim 3 wherein said base member includes a pair of circular openings disposed in horizontal alignment between said first slot and said second slot.

6. A shoulder strap fastener as described in claim 5 wherein said fastener means comprises a button that is fixedly attached to said base member by loops of thread that pass through said circular openings and said button.

7. An adjustable shoulder strap fastener for an article of clothing having a shoulder strap and a bib portion, said shoulder strap fastener comprising a rectangular base member formed of pliable material having three transversely extending slots formed therein in parallel alignment, a first slot being formed in the upper portion of said base member and respective second and third slots being formed in the lower portion of said base member, said shoulder strap being attachable to said base member by threaded engagement of said strap within the transversely extending slots of said base member, the distance between said first slot and said second slot being relatively wider than the distance between said second slot and said third slot for receipt of a button member; and a button member disposed between said first slot and said second slot which selectively engages the bib portion of said article of clothing thereby providing selective attachment of said shoulder strap and the bib potion of said article of clothing, said button member being integrally formed with the forward face of said base member.

8. A shoulder strap fastener as described in claim 7 wherein said button member is separately formed from said base member and includes a button member base, said button member base being attachable to said base member by adhesive means disposed on the button member base.

9. A shoulder strap fastener as described in claim 7 wherein said button member is separately formed from said base member and includes a button member base, said button member base being attachable to said base member detachable means.

10. A shoulder strap fastener as described in claim 7 wherein said button member includes a button member base integrally disposed adjacent to the forward face of the base member, said button member base having a neck formed with a convexly-curved wall of narrowing diameter which forwardly extends to an integrally formed button member head, said button member head being provided for engagement with a buttonhole in the bib portion of said article of clothing to which the shoulder strap fastener is attached.

11. An adjustable shoulder strap fastener for an article of clothing having a shoulder strap and a bib portion, said shoulder strap fastener comprising a rectangular base member having three transversely extending slots formed therein in parallel alignment, a first slot being formed in the upper portion of said base member and respective second and third slots being formed in the lower portion of said base member, the distance between said first slot and said second slot being relatively wider than the distance between said second slot and said third slot for receipt of fastener means, said base member being formed of pliable material and said shoulder strap being attachable to said base member by threaded engagement of said strap within the transversely extending slots of said base member; and fastener means fixedly attached to said base member between said first slot and said second slot which selectively engage the bib portion of said article of clothing thereby providing selective attachment of said shoulder strap and the bib portion of said article of clothing.

12. A shoulder strap fastener as described in claim 11 wherein said fastener means is a button.

* * * * *